US007541861B1

(12) United States Patent
Aslan et al.

(10) Patent No.: US 7,541,861 B1
(45) Date of Patent: Jun. 2, 2009

(54) MATCHING FOR TIME MULTIPLEXED TRANSISTORS

(75) Inventors: Mehmet Aslan, Sunnyvale, CA (US); Dan D'Aquino, San Diego, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 300 days.

(21) Appl. No.: 11/315,511

(22) Filed: Dec. 21, 2005

Related U.S. Application Data

(60) Provisional application No. 60/719,836, filed on Sep. 23, 2005.

(51) Int. Cl.
*G05F 1/10* (2006.01)
*G05F 3/02* (2006.01)

(52) U.S. Cl. ..... 327/538; 327/543

(58) Field of Classification Search ..... 327/538, 327/540, 541, 543
See application file for complete search history.

(56) References Cited

U.S. PATENT DOCUMENTS 6,456,513 B2 * 9/2002 Saito ..... 363/59
6,789,939 B2 * 9/2004 Schrodinger et al. ..... 374/178
2004/0264223 A1 * 12/2004 Pihlstrom et al. ..... 363/89

* cited by examiner

*Primary Examiner*—Kenneth B Wells
*Assistant Examiner*—Daniel Rojas

(57) ABSTRACT

An embodiment of the present invention is directed to a method of matching currents to a known ratio including generating a control signal from a control circuit, which includes a value that defines a configuration. The method also includes receiving the control signal at a switching circuit, detecting whether the value of the control signal has changed, and, provided the value has changed, switching a plurality of transistors from a first configuration to a second configuration. The first configuration produces a first current in a first circuit and a second circuit, and the second configuration produces a second current in a first circuit and a second circuit. The ratio of the first current and the second current are the aforementioned known ratio.

10 Claims, 5 Drawing Sheets

400

MATCHING FOR TIME MULTIPLEXED TRANSISTORS

CROSS REFERENCES TO RELATED APPLICATIONS

This application claims priority to provisional patent application Ser. No. 60/719,836, entitled "Improved Matching for Time Multiplexed Transistors," with filing date Sep. 23, 2005, and assigned to the assignee of the present invention, the disclosure of which is hereby incorporated by reference. This application is related to co-pending patent application Ser. No. 11/315,527, entitled "Improved Matching For Time Multiplexed Resistors," with filing date Dec. 21, 2005, and assigned to the assignee of the present invention, the disclosure of which is hereby incorporated by reference. This application is also related to co-pending patent application Ser. No. 11/314,066, entitled "Systems and Methods for Adjusting Parameters of a Temperature Sensor for Settling Time Reduction," with filing date Dec. 20, 2005, and assigned to the assignee of the present invention, the disclosure of which is hereby incorporated by reference.

BACKGROUND OF THE INVENTION

Various electronic applications exist that involve sending varying currents through a circuit and then reading and recording the output voltage that corresponds to each current. In many cases, this output voltage is the base-emitter voltage, a p-n junction, of a bipolar junction transistor (BJT). One such circuit is an electronic temperature sensor circuit that is configured to measure the temperature on a remote (separate) silicon chip by providing two target collector currents ($I_{C1}$, $I_{C2}$) to a p-n junction located on the remote chip. This circuit measures two diode voltages ($V_{BE1}$, $V_{BE2}$) of this p-n junction and processes the diode voltages to determine the actual temperature at the remote location. Most p-n junctions employed for this purpose are parasitic vertical p-n-p silicon based transistors. Also, the temperature sensor circuit is usually arranged to control the emitter currents of the transistor.

The classic diode equation determines a change in the base emitter voltage ($\Delta V_{BE}$) for a p-n-p transistor as follows:

$$\Delta Vbe = \eta \frac{\kappa T}{q} \ln\left(\frac{I_{C1}}{I_{C2}}\right) \tag{1}$$

where η is a non-ideality constant substantially equivalent to 1.00 or slightly more/less, κ is the well known Boltzmann's constant, q is the electron charge, T is the temperature in Kelvin, $I_{C1}$ is a first collector current, and $I_{C2}$ is a second collector current that are present at the measurement of a first base-emitter voltage and a second base-emitter voltage.

The classic diode equation is often employed to determine the actual temperature at a remotely located p-n-p transistor based on a ratio of approximated collector currents. In the past, since a ratio of collector currents tended to be relatively equivalent to a ratio of known emitter currents ($I_E$), the diode equation could be accurately approximated in a rewritten form that follows:

$$T = \frac{\Delta V_{BE}}{\eta \frac{\kappa}{q} \ln\left(\frac{I_{E1}}{I_{E2}}\right)}; \text{ where } \frac{I_{C1}}{I_{C2}} = \frac{I_{E1}}{I_{E2}} \tag{2}$$

However, due in part to process variations for integrated circuits with smaller process geometries, the assumption regarding relatively equivalent ratios may no longer be valid. The beta (ratio of collector current over base current) has been shown to vary as much as ten percent or more between two known emitter currents for p-n-p transistors in integrated circuits manufactured from relatively smaller process geometries. Thus, the diode equation approximation (Equation 2) regarding the ratios of collector and emitter currents for a transistor can cause relatively inaccurate temperature measurements in an integrated circuit based on smaller process geometries. Relatively significant inaccurate temperature measurements can occur in integrated circuits that have process geometries of 90 nanometers or less. It should be appreciated that these measurements represent examples of problems experienced, and different manufacturers may start showing these effects at different process geometries.

Subsequent art provided for a more accurate temperature measurement for a transistor with a rewritten form of the diode equation (Equation 3) that provides for actually measuring or controlling the ratio of collector currents instead of the ratio of emitter currents.

$$T = \frac{\Delta V_{BE}}{\eta \frac{\kappa}{q} \ln\left(\frac{I_{C1}}{I_{C2}}\right)} \tag{3}$$

The disadvantage of this method, however, was that it required measuring $I_C$ and converting it to a digital form in real-time, which, when done accurately, is extremely expensive.

Yet another alternative has been to drive the collector currents to a predetermined ratio, thus eliminating the need to measure the collector currents independently. Consequently, Equation 3 can be rewritten as:

$$T = \frac{\Delta V_{BE}}{\eta \frac{\kappa}{q} \ln N} \tag{4}$$

Previously, this has been accomplished by using a simple multiplexer that switches between a first current source and a second current source. The disadvantage to this method is that switching between two independent currents sources introduces transistor mismatch. In other words, the threshold voltage ($V_t$) associated with each current source may be mismatched. Furthermore, the circuit must account for two different overdrives. Thus, the variations in threshold voltage and overdrive cause deviations from the desired ratio.

SUMMARY OF THE INVENTION

An embodiment of the present invention is directed to a method of matching currents to a known ratio, including generating a control signal from a control circuit, which includes a value that defines a configuration. The method also includes receiving the control signal at a switching circuit, detecting whether the value of the control signal has changed, and, provided the value has changed, switching a plurality of transistors from a first configuration to a second configuration. The first configuration produces a first current in a first circuit and a second circuit, and the second configuration produces a second current in a first circuit and a second circuit. The ratio of the first current and the second current are the aforementioned known ratio.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description of the Invention, which is to be read in association with the accompanying drawings, wherein.

DETAILED DESCRIPTION OF THE INVENTION

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

Figure 1:
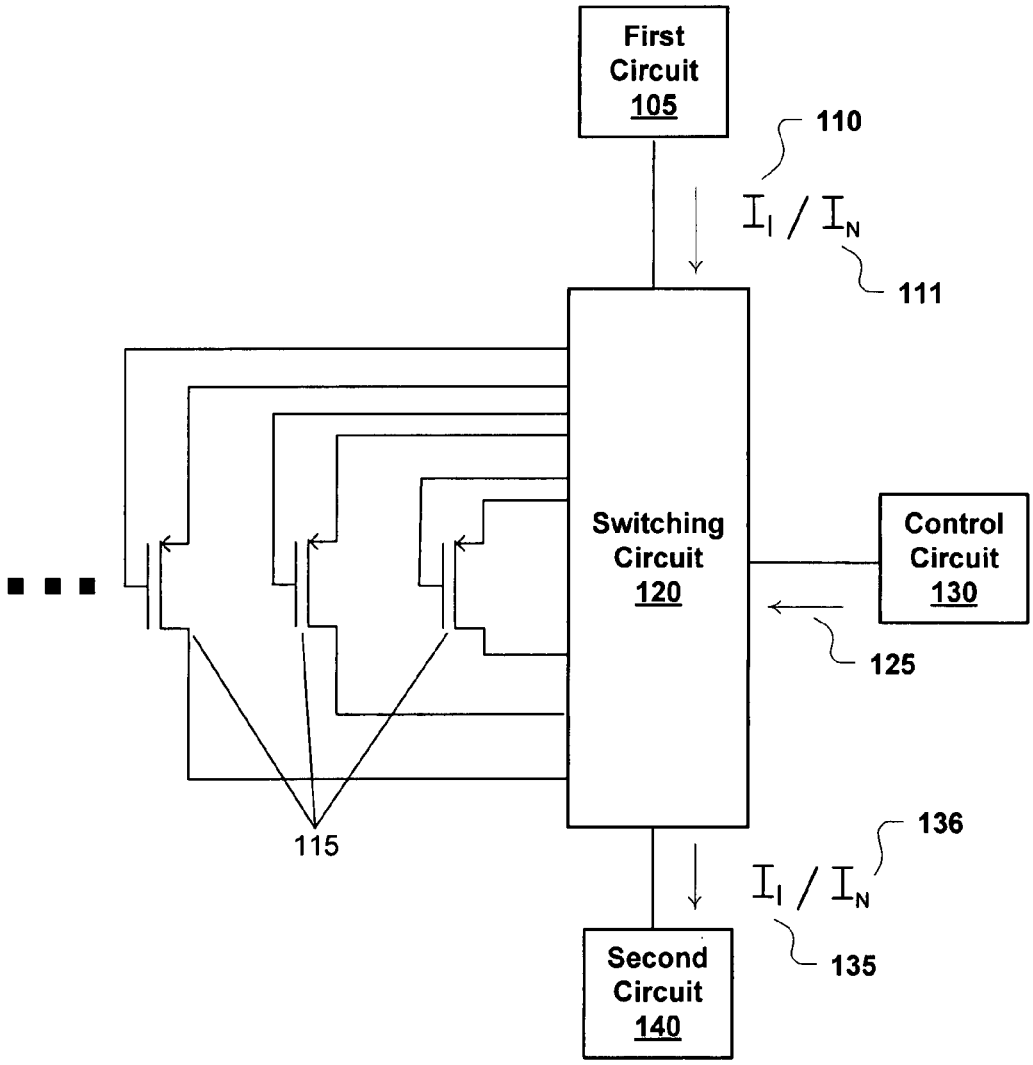
FIG. 1 shows a block diagram of an apparatus, in accordance with an embodiment of the present invention.
Figure 2:
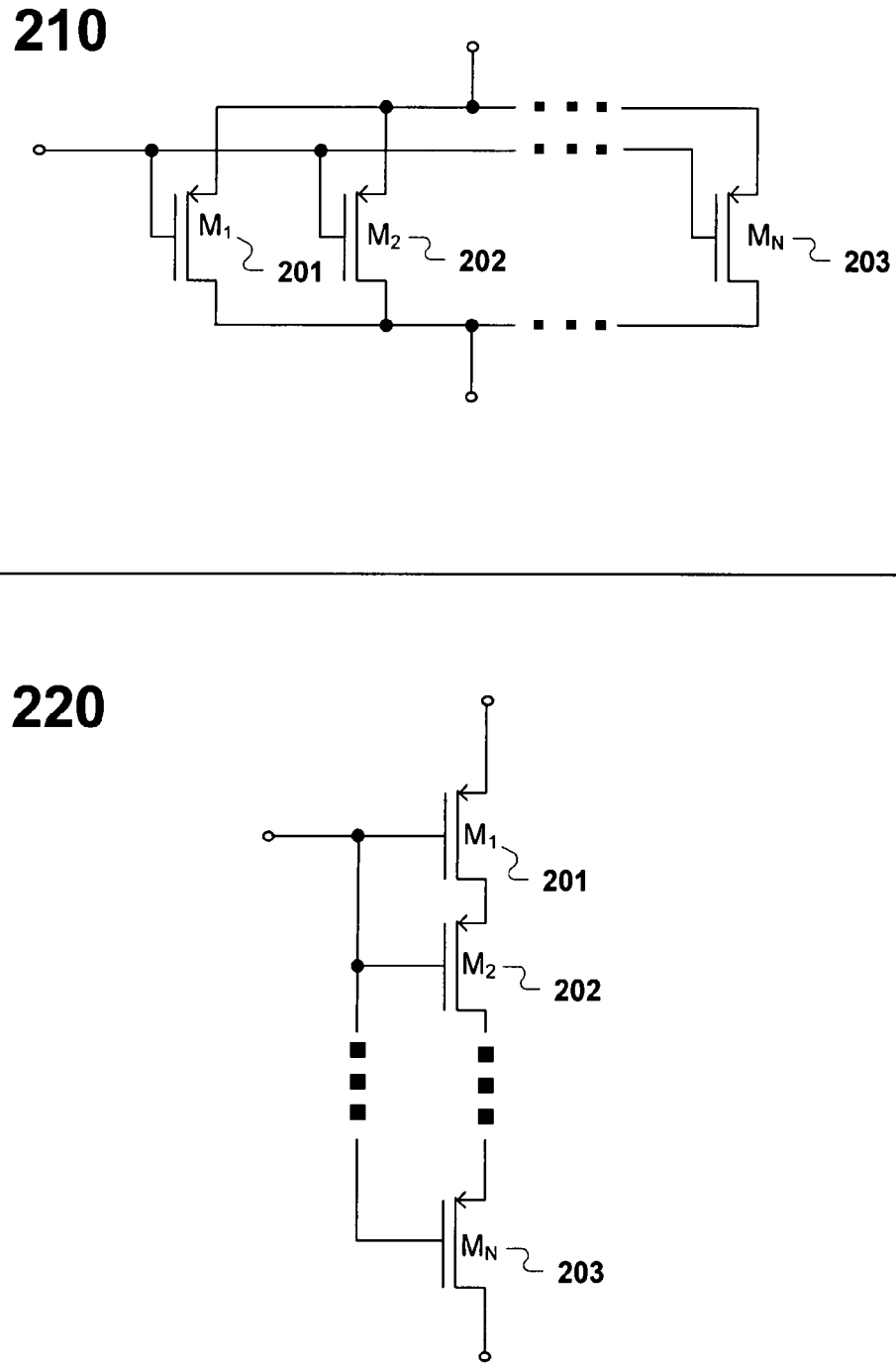
FIG. 2 illustrates the different configurations achieved by a matched transistor array, in accordance with an embodiment of the present invention.

Briefly stated, an embodiment is directed to an apparatus and method for improved matching for time-multiplexed transistors. FIG. 1 shows a block diagram of an embodiment. The apparatus 100 in FIG. 1 comprises a plurality of transistors 115. A switching circuit 120 is coupled to the transistors. The switching 120 circuit switches the transistors 115 from a first configuration to a second configuration. In an exemplary embodiment, the switching circuit switches the transistors 115 between series and parallel configurations. FIG. 2 illustrates parallel 210 and series 220 configurations of a plurality of transistors 115 comprising N number of transistors 201-203. The transistors 201-203 are matched as best as possible. In parallel configuration 210, transistors 201-203 have their drains, gates, and sources coupled together by switches (not shown). In series configuration 220, the gates of the transistors 201-203 remain tied together, but their drains and sources are reconnected to form a series chain. Thus, M, 201 is coupled in series with $M_2$ 202, $M_2$ 202 is coupled in series with $M_3$ (not shown), and so on, terminating with $M_{N-1}$ (not shown) coupled in series with $M_N$ 203.

The switching circuit 120 is also coupled to a first circuit 105 and a second circuit 140. The first circuit 105 and second circuit 140 can be any combination of wires, sources, and/or components. It is appreciated that the first circuit 105 and the second circuit 140 could therefore simply be a voltage potential. The first configuration of the transistors 115 produces a first current 110 and 135 in both the first circuit 105 and the second circuit 140. The second configuration of the transistors 115 produces a second current 111 and 136 in both the first circuit 105 and the second circuit 140.

The switching circuit 120 is also coupled to a control circuit 130. The control circuit 130 generates a control signal 125, which is received by the switching circuit 120. In one embodiment, the control circuit 130 includes a processor. In another embodiment, the control circuit 130 includes a programmable integrated circuit. The control signal 125 comprises a value that defines a configuration of the transistors 115. In one embodiment, the control signal is simple 1-bit logic, thus changing the transistors 115 between two possible configurations. It is appreciated that the control signal could have more bits in order to accommodate more configurations.

Figure 3:
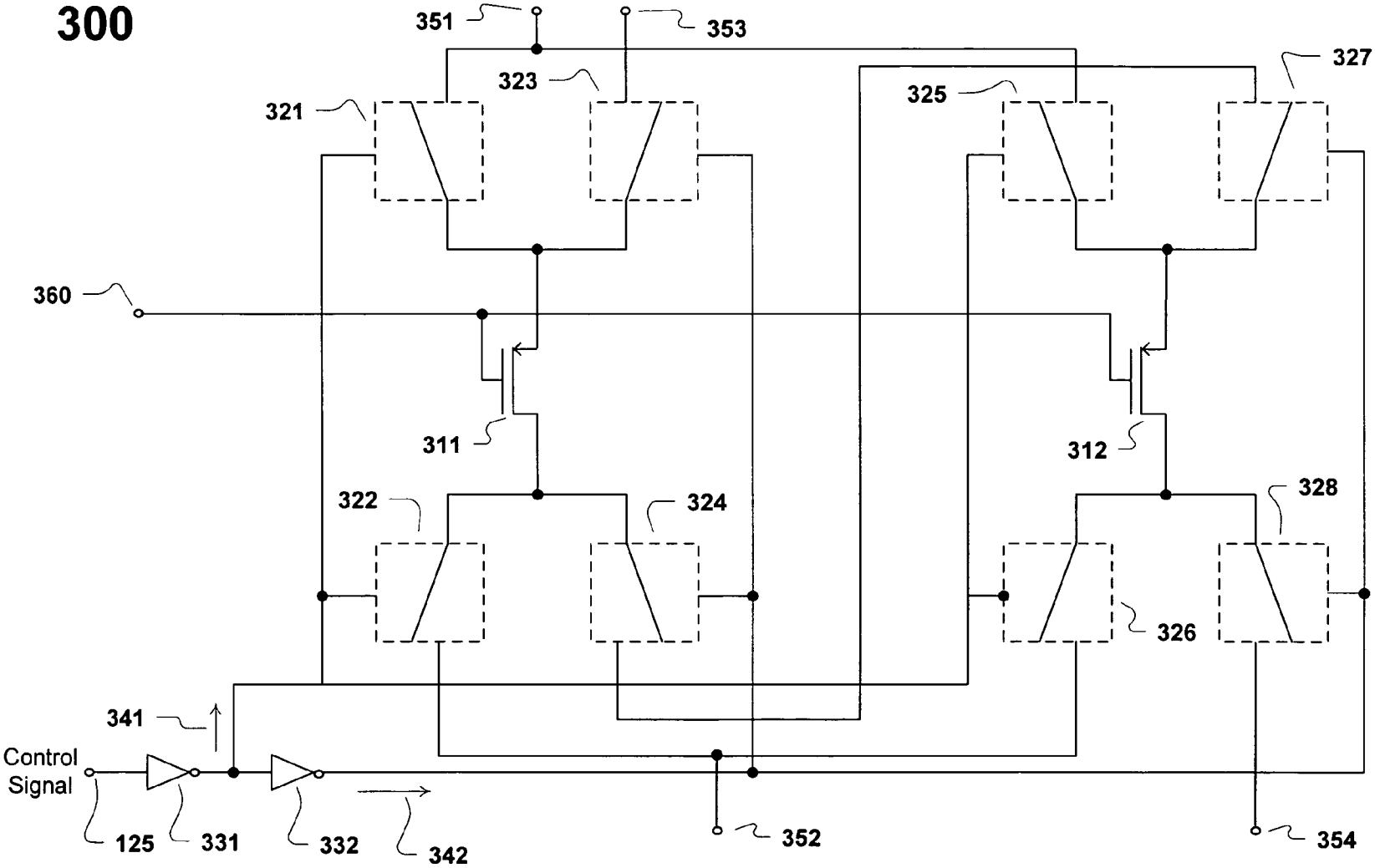
FIG. 3 shows an exemplary schematic diagram of a switching circuit of an embodiment of the present invention at the component level.

FIG. 3 illustrates an exemplary embodiment of a switching circuit 300 for switching at least two PMOS transistors from a first configuration to a second configuration. It should be appreciated that a similar circuit can be achieved using NMOS transistors rather than PMOS transistors. The circuit 300 receives the control signal 125 at the input of a first inverter 331, which generates a first switching signal 341. The output of the first inverter 331 is coupled to the input of a second inverter 332, which generates a second switching signal 342.

Each transistor 311 and 312 is coupled to four switches, 321-324 and 325-328 respectively. The first switch 321 is coupled between a first node 351 and the source of the first transistor 311. The second switch 322 is coupled between the drain of the first transistor and a second node 352. The third switch 323 is coupled between a third node 353 and the source of the first transistor 311. The fourth switch 324 is coupled between the drain of the first transistor 311 and the seventh switch 327. The fifth switch 325 is coupled between the first node 351 and to the source of the second transistor 312. The sixth switch 326 is coupled between the drain of the second transistor 312 and the second node 352. The seventh switch 327 is coupled between the fourth switch 324 and the source of the second transistor 312. The eighth switch 328 is coupled between the drain of the second transistor 312 and a fourth node 354. The first node 351 serves as the attachment point for the first circuit 105. The second node 352 serves as the attachment point for the second circuit 140. The third node 353 either attaches to the first node 351 or to an additional switch (not shown), similar to the manner in which switches 324 and 327 are coupled, for the purpose of coupling an additional transistor (not shown) to the array. The fourth node either attaches to the second node or to an additional switch (not shown), similar to the manner in which switches 324 and 327 are coupled, for the purpose of coupling an additional transistor (not shown) to the array. In one embodiment, the preferred connection for the bulk terminal of each transistor is to the transistor's source.

The first switching signal 341 controls switches 321-322 and 325-326. The second switching signal 342, which is the inverse of the first switching signal 341, controls switches 323-324 and 327-328. Thus at any given moment, either switches 323-324 and 327-328 are closed and switches 321-322 and 325-326 are open or vise versa. When the first switching signal is active, switches 321-322 and 325-326 are closed and the transistors 311-312 will effectively be in parallel configuration. When the second switching signal is active, switches 323-324 and 327-328 are closed and the transistors 311-312 will effectively be in series configuration. Thus, for an appropriate forward bias voltage 360, the series and parallel configurations will produce a small and a large current respectively, the currents having a predicable ratio to each other based on the number of transistors in the array.

In determining the desired current ratio, for reasons that will become apparent below it is preferred to select a ratio that is a square number. If the ratio is a square number, N, the number of transistors needed in the array is $\sqrt{N}$. For example, if four transistors are used, and the first configuration and the second configuration are parallel and series respectively, the ratio of the first current to the second current would be 16:1.

Determining the transistor configuration to achieve a non-square ratio is slightly more complicated. To do so requires factoring the desired ratio into two factors. These factors will then represent the number of transistors that must be used in the series and parallel configurations. For example, if the desired ratio is 20:1, the configuration options would be either 5×4 or 10×2. The 5×4 configuration would be preferred since 5 and 4 are the closest factors to a square. Thus, to achieve a 20:1 ratio would require placing five transistors in series and four in parallel or, alternatively, four in series and five in parallel.

Re-configuring multiple transistors in this manner, rather than simply using one high-current transistor and one low-current transistor, significantly improves the transistor matching, and thus the current matching. By using the exact same transistors to generate the large current that are used to generate the smaller current, the circuit will account for the variations in the threshold voltages and overdrives of the transistors. The overall overdrive will be the same under either configuration. Furthermore, even though non-idealities in the threshold voltages will produce an error factor to appear in the currents, the ratio of the error currents will also be N:1. Thus, the desired ratio is still preserved.

It is appreciated that in a situation where a non-square ratio is desired, the effects of the variation in one or more of the transistors does not appear in both the large and the small currents. Hence, using an equal number of transistors in both series and parallel configurations to achieve a square ratio is preferred.

Figure 4:
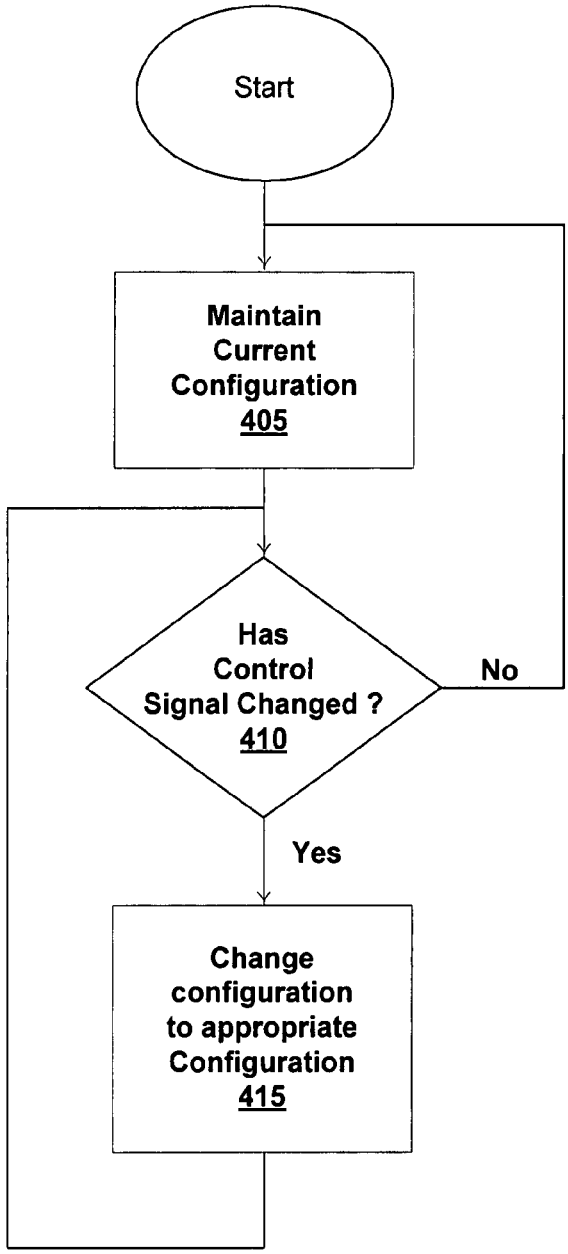
FIG. 4 shows a flowchart of a method of matching currents, in accordance with an embodiment of the present invention.

FIG. 4 illustrates a flowchart of the process 400 by which an embodiment matches currents to a known ratio. As described above, the control circuit 130 generates a control signal 125, which is received by the switching circuit 120. The switching circuit 120 maintains the current configuration 405 of the transistors 115 while monitoring the control signal 125 for a change. If the switching circuit 120 detects a change 410, it changes the configuration of the transistors from the first configuration to a second configuration 415 corresponding to the new control signal.

An exemplary embodiment could be used to accurately measure the temperature of a remotely located transistor based at least in part on a ratio of two target collector currents ($I_{C1}$,$I_{C2}$) and two measurements of the base-emitter voltage ($V_{BE1}$, $V_{BE2}$) of the transistor. By employing an embodiment in this application, $I_{C1}$ and $I_{C2}$ can be driven to a pre-determined ratio more accurately than previously, thus leading to more accurate temperature readings.

Figure 5:
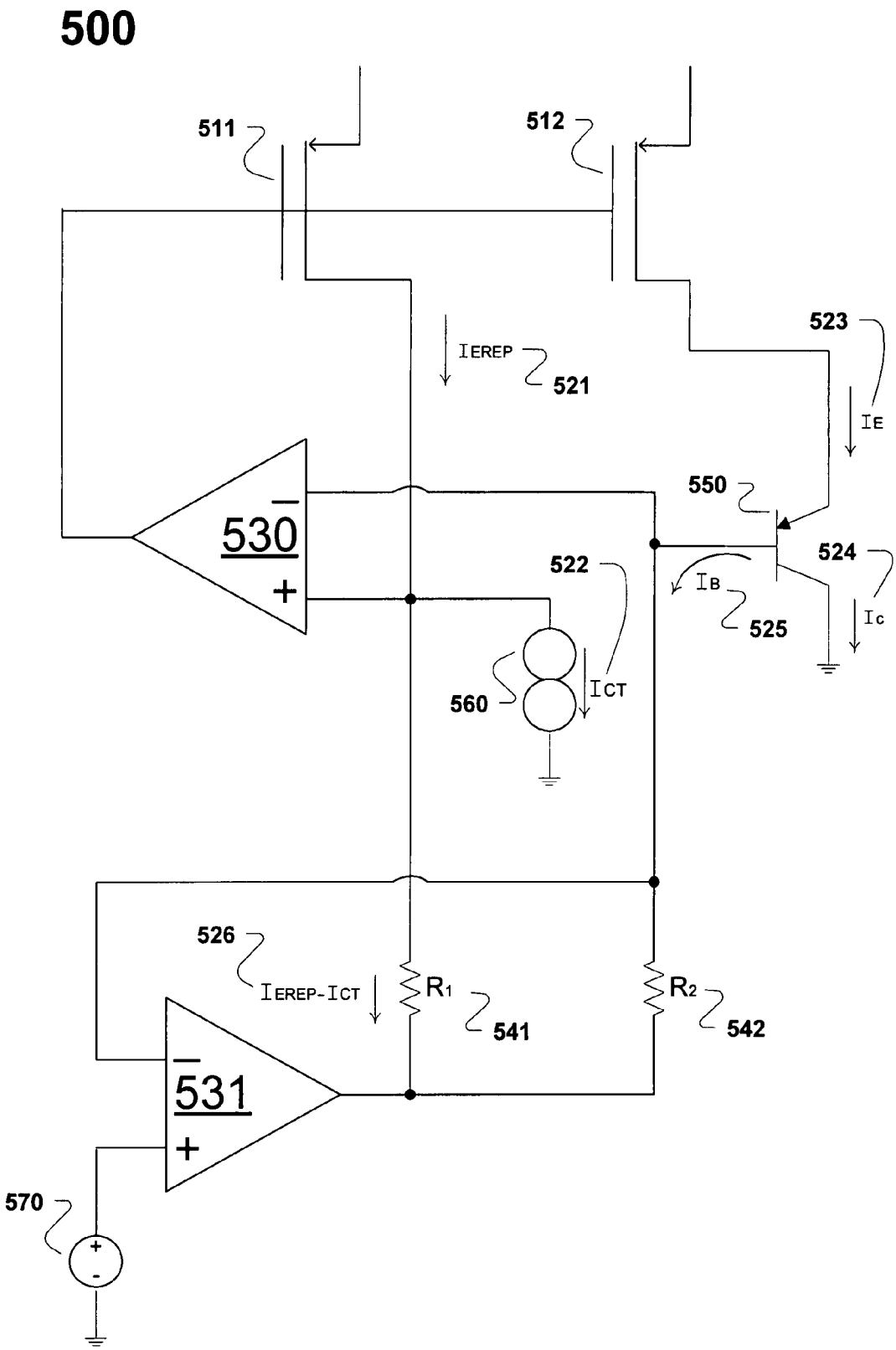
FIG. 5 shows a schematic diagram of an embodiment of the present invention at a general level in which the application is temperature sensing.

FIG. 5 shows an exemplary schematic diagram of a general overview of an embodiment as used in a temperature sensing circuit, where transistors 511 and 512 are not single transistors, but rather exemplary transistor arrays as shown in FIG. 2 comprising four transistors each. In an exemplary embodiment, the transistor array switches two sets of four transistors between parallel and series configurations in order to achieve a larger current and a smaller current respectively, the ratio of which is N:1. Transistor array 512 drives an emitter current 523 into BJT 550. Transistor array 511 acts as a current mirror and generates a replica current 521 of the emitter current 523. Thus:

$$I_{EREP}=I_E \tag{5}$$

Voltage source 570 sets an offset voltage, which is maintained over $R_2$ 542 by op-amp 531. It should be appreciated that adding an offset voltage, while not necessary, improves the accuracy of the circuit. Op-amp 530 drives arrays 511 and 512 in order to equalize the voltage across resistors 541 and 542. Thus, the currents through resistors 541 and 542 are equal. The current through resistor 542 is the base current ($I_B$) of the BJT 550. The current through resistor 541 can be expressed as $I_{EREP}-I_{CT}$, where $I_{CT}$ is a target collector current generated by programmable current source 560. Thus:

$$I_{EREP}-I_{CT}=I_B \tag{6}$$

Substituting for $I_B$:

$$I_{EREP}-I_{CT}=I_E-I_C \tag{7}$$

Substituting Equation 5:

$$I_{CT}=I_C \tag{8}$$

Arrays 511 and 512, in conjunction with current source 560, may then drive two collector currents 524. In one embodiment, programmable current source 560 maintains a higher $I_{CT}$ when the circuit is in the high-current mode, and it maintains a lower $I_{CT}$ when the circuit is in the low-current mode. Because arrays of four transistors are used, the ratio of the collector currents can be approximated as 16:1 with a high degree of accuracy. Thus, $\Delta V_{BE}$ is the only measurement necessary to accurately determine the temperature of the chip containing BJT 550 (see Equation 4).

Thus, the above embodiments are able to generate two or more currents in a known ratio. As discussed, the embodiments generate the ratio with a high degree of accuracy because the variations in the transistors have been accounted for. Furthermore, in some applications that involve sending varying currents through a circuit and then reading and recording the output voltage that corresponds to each current, it is no longer necessary to measure the currents because their ratio can be predicted with accuracy.

What is claimed is:

1. In a temperature sensor, a method of matching transistors to generate currents of a known ratio, said method comprising:

generating a control signal from a control circuit, wherein said control signal comprises a value that defines a configuration;

detecting whether said value of said control signal has changed; and provided said value has changed, switching a plurality of transistors from one configuration to a different configuration, wherein there are at least four transistors in said plurality of transistors and wherein a first configuration comprises connecting said at least four transistors in parallel and a second configuration comprises connecting the same said at least four transistors in series, wherein said first configuration produces a first current in a first circuit and in a second circuit, wherein said second configuration produces a second current in said first circuit and in said second circuit, wherein the ratio of said first current to said second current is said known ratio, and wherein said ratio of said first current to said second current is used to determine a temperature at a device coupled to said plurality of transistors.

2. The method as recited in claim 1 wherein the ratio of any error attributable to said first configuration to any error attributable to said second configuration is also equal to said known ratio.

3. The method as recited in claim 1 wherein said at least four transistors comprises a first transistor and a second transistor, and wherein said switching comprises:

inverting said control signal to produce a first switching signal;

inverting said first switching signal to produce a second switching signal;

controlling a first switching device with said second switching signal, wherein said first switching device is coupled between a first node and a first terminal of said first transistor;

controlling a second switching device with said second switching signal, wherein said second switching device is coupled between a second terminal of said first transistor and a second node;

controlling a third switching device with said first switching signal, wherein said second switching device is coupled between a third node and said first terminal of said first transistor;

controlling a fourth switching device with said first switching signal, wherein said fourth switching device is coupled between said second terminal of said first transistor and a seventh switching device;

controlling a fifth switching device with said second switching signal, wherein said fifth switching device is coupled between said first node and a first terminal of said second transistor;

controlling a sixth switching device with said second switching signal, wherein said sixth switching device is coupled to a second terminal of said second transistor and said second node;

controlling said seventh switching device with said first switching signal, wherein said seventh switching device is coupled between said fourth switching device and said first terminal of said second transistor; and controlling an eighth switching device with said first switching signal, wherein said eighth switching device is coupled between said second terminal of said second transistor and a fourth node.

4. The method as recited in claim 1 wherein said predetermined ratio is a square-number.

5. An apparatus for matching transistors to generate currents to a known ratio comprising:

a plurality of transistors, wherein there are at least four transistors in said plurality;

a switching circuit coupled to said transistors, said switching circuit for switching said transistors from one configuration to a different configuration in response to a control signal, wherein a first configuration comprises connecting all of said at least four transistors in parallel and a second configuration comprises connecting all of said at least four transistors in series, wherein said first configuration produces a first current in a first circuit and in a second circuit and said second configuration produces a second current in said first circuit and in said second circuit, wherein the ratio of said first current to said second current is said known ratio;

a control circuit coupled to said switching circuit, wherein said control circuit sends said control signal to said switching circuit; and an additional transistor coupled to said plurality of transistors, wherein said ratio of said first current to said second current and the difference between a first base-emitter voltage of said additional transistor measured with said plurality of transistors in said first configuration and a second base-emitter voltage of said additional transistor measured with said plurality of transistors in said second configuration are used to determine a temperature of a chip that includes said transistor.

6. The apparatus as recited in claim 5 wherein said first configuration produces a first error current in said first circuit and said second circuit, wherein said second configuration produces a second error current in said first circuit and said second circuit, and wherein the ratio of said first error current and said second error current is also equal to said pre-determined ratio.

7. The apparatus as recited in claim 5 wherein said plurality of transistors comprises a first transistor and a second transistor, and wherein said switching circuit comprises:

a first inverter having an input coupled to said control signal;

a second inverter coupled to said first inverter;

a first switching device coupled between a first node and a first terminal of said first transistor, wherein said first switching device is controlled by an output of said second inverter;

a second switching device coupled between a second terminal of said first transistor and a second node, wherein said second switching device is controlled by said output of said second inverter;

a third switching device coupled between a third node and said first terminal of said first transistor, wherein said third switching device is controlled by an output of said first inverter;

a fourth switching device coupled between said second terminal of said first transistor and a seventh switching device, wherein said fourth switching device is controlled by said output of said first inverter;

a fifth switching device coupled between said first node and a first terminal of said second transistor, wherein said fifth switching device is controlled by said output of said second inverter;

a sixth switching device coupled between a second terminal of said second transistor and said second node, wherein said sixth switching device is controlled by said output of said second inverter;

said seventh switching device coupled between said fourth switching device and said first terminal of said second transistor, wherein said seventh switching device is controlled by said output of said first inverter; and an eighth switching device coupled between said second terminal of said second transistor and a fourth node, wherein said eighth switching device is controlled by said output of said first inverter.

8. The apparatus as recited in claim 7 wherein said first transistor and said second transistor are controlled by a bias signal.

9. The apparatus as recited in claim 5 wherein said predetermined ratio is a square number.

10. An apparatus for measuring the temperature of a transistor comprising:

a circuit for changing a collector current of said transistor between a first collector current and a second target collector current, said circuit comprising:

a plurality of transistors, wherein there are at least four transistors in said plurality;

a switching circuit coupled to said transistors, said switching circuit for switching said transistors from one configuration to a different configuration in response to a control signal, wherein a first configuration comprises connecting said at least four transistors in parallel and a second configuration comprises connecting the same said at least four transistors in series, wherein said first configuration produces a first current and said second configuration produces a second current, wherein the ratio of said first current to said second current is $N^2$-to-one; and a control circuit coupled to said switching circuit, wherein said control circuit sends said control signal to said switching circuit; and a circuit for measuring a first base-emitter voltage of said transistor corresponding to said first collector current of said transistor and measuring a second base-emitter voltage of said transistor corresponding to said second collector current, wherein said first and second base-emitter voltages and the ratio of said first current to said second current are used to determine said temperature.

* * * * *